United States Patent [19]

Roark et al.

[11] Patent Number: 5,040,703

[45] Date of Patent: Aug. 20, 1991

[54] BOTTLE CLOSURE SYSTEM WITH REPRESSURIZATION AND DISPENSING MEANS

[76] Inventors: Brian M. Roark; James B. Roark, both of 2411 Meadow Creek Dr., Carrollton, Tex. 75006

[21] Appl. No.: 392,555

[22] Filed: Aug. 11, 1989

[51] Int. Cl.[5] ..... B67B 3/20

[52] U.S. Cl. ..... 222/173; 222/400.5; 222/400.8

[58] Field of Search ..... 222/399, 400.7, 400.8, 222/542, 562, 400.5; 215/4, 272, 274; 277/201; 403/290, 344; 211/74; 248/146, 152

[56] References Cited

U.S. PATENT DOCUMENTS 2,194,653 3/1980 Brown ..... 222/402.25
2,444,779 7/1948 Krasberg ..... 215/272

FOREIGN PATENT DOCUMENTS 2172578 9/1986 United Kingdom ..... 222/399

*Primary Examiner*—Michael S. Huppert
*Assistant Examiner*—Philippe Derakshani
*Attorney, Agent, or Firm*—Michael J. Caddell

[57] ABSTRACT

An assembly is disclosed for maintaining the carbonation level in a carbonated soft-drink beverage and for dispensing the beverage from its container while minimizing carbonation loss from the container. The assembly utilizes a closure cap assembly that has inlet pressurization means, outlet dispensing means, and a siphon tube internally locatable in a beverage bottle.

10 Claims, 2 Drawing Sheets

FIG. 1
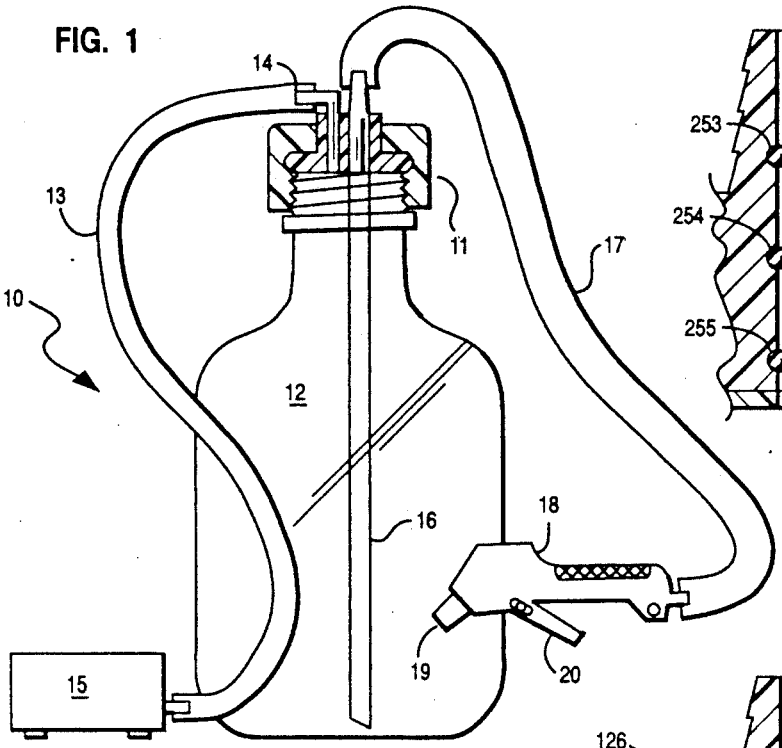
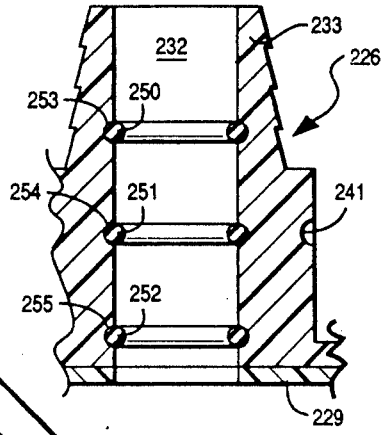
FIG. 4
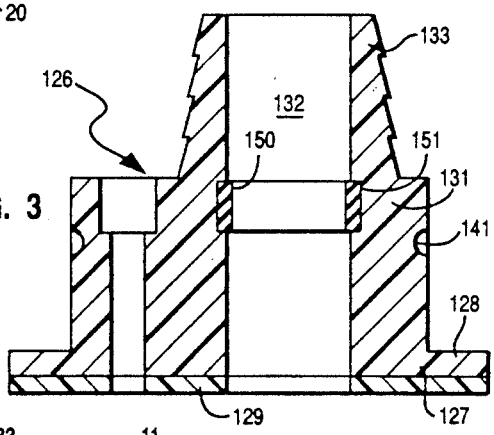
FIG. 3
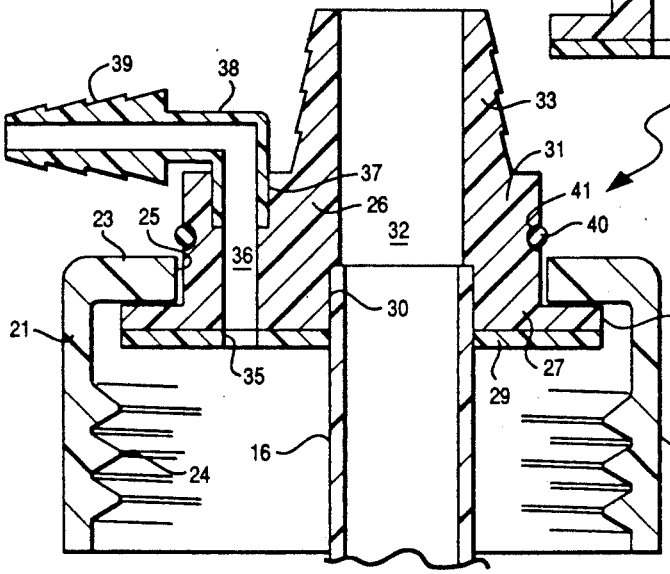
FIG. 2

BOTTLE CLOSURE SYSTEM WITH REPRESSURIZATION AND DISPENSING MEANS

BACKGROUND AND SUMMARY OF THE INVENTION

The present invention comprises a closure system for use on beverage bottles and more particularly discloses a bottle cap assembly for use on carbonated beverage bottles, which assembly maintains carbonation in the beverage and likwise provides a means for dispensing the beverage without depleting the carbon dioxide in the beverage bottle.

Carbonated drinks such as colas and fruit drinks are often sold in large plastic containers, often in sizes as large as three liters, which containers are made of a relatively permeable plastic material such as poly(ethyleneterephthalate), commonly called "PET". Bottlers may add as much as four atmospheres of CO2 pressure to the "headspace" of the filled bottle to maintain acceptable levels of carbonation in the soft drink beverage. This also contributes to rigidity of the filled container during shipment and on the grocer's shelves.

Unfortunately, Pet is a relatively permeable plastic for carbonation (CO2), and allows the gas to continuously permeate out through the container wall. In addition, as the volume of beverage in the container is slowly reduced by the consumer, the headspace increases and allows more open volume for CO2 to evolve into from the liquid drink. Also, each time the large container is opened, the CO2 pressure in the headspace is lost into the atmosphere, thereby increasing the rate of loss from the beverage.

Marketing studies have revealed that the average consumer considers a carbonated beverage to be "flat" when it has lost only about fifteen percent (15%) of its original carbonation. Because of CO2 loss through the container walls and through constant evacuation of the headspace, this level usually occurs before the typical two or three liter bottle is completely empty of beverage.

Thus there is a need in the beverage packaging business for means to reduce or prevent the "headspace" CO2 loss and to offset the permeation loss through the container walls.

Conventional closure devices for carbonated beverage bottles suffer several serious disadvantages. For example, the Saponara, U.S. Pat. No. 4,033,091, discloses a double-cap apparatus with an inner cap providing a closure member to be threaded onto a beverage bottle. A second threaded assembly, carrying a scissors-operated bellows, is threaded onto the exterior of the inner cap. The Saponara closure device suffers from the disadvantages of being bulky and too tall to fit into many refrigerators; requiring that the cap be removed to pour beverage from the bottle, thereby losing all of the carbonation pressure in the bottle; being expensive to make and having complex structure; providing poor sealing with a single ball checkvalve; and, requiring a large scissors system to get enough mechanical advantage to give any significant pressure gain in the bottle.

U.S. Pat. No. 3,557,986 to Poole discloses a closure system comprising a rubber cap that is stretched over a bottle top and has a rubber chamber formed above or to the side of the top. It suffers from the disadvantage that the resilient body will not hold pressure since internal pressure will expand the cap away from the bottle neck and allow carbonation to bleed off. Also the rubber walls of the device offer little barrier to gas loss through permeation. Other disadvantages of the Poole closure are that the low volume of the chamber and inefficient pumping action of the bulb-type chamber would require many flexings to obtain any significant pressure increase; the rubber material of the bulb would soon fatigue and start to crack as a result of the many flexings and the corrosive nature of carbonated beverages; and, the closure has to be removed each time beverage is dispensed. Each removal evacuates the headspace.

U.S. Pat. No. 4,524,877 to Saxby discloses a screw-on closure cap having a plunger/piston passing through the cap and into the bottle. It suffers from the disadvantages of having such a small volume in the piston assembly, which is limited by the size of the bottle neck it must fit into, that it requires an enormous amount of pump strokes to get measurable pressurization in the beverage container; and, the assembly has to be removed in order to pour beverage from the bottle each time.

It should also be noted that none of the conventional devices automatically replace carbonation (CO2 pressure) as it is lost via permeation through plastic container walls. This lost pressure is redeveloped by sacrificing carbonation from the beverage to the headspace. All of the devices require that the closures be removed in order to pour liquids from the bottle, thereby losing all the carbonation in the "headspace" of the bottle.

In addition to the conventional closure devices described above, several apparatus for generating carbonated beverage from plain water are known commercially. For example, U.S. Pat. Nos. 4,306,667, 4,359,432, and 4,376,496, all to Sedam et al, disclose large and complex commercial-scale carbonated beverage generating systems utilizing a large plain-water reservoir, a carbonating device, and the primary feature which is a "disposable package for containing and dispensing the syrup of the post-mix beverage". These do not disclose apparatus usable as closures on carbonated beverage bottles.

The present invention overcomes these disadvantages by providing a compact closure assembly that allows for continuous repressurization of the beverage, provides a pressurized dispensing system, and does not allow the headspace carbonation to be depleted every time beverage is dispensed. It performs these functions by the provision of a bottle closure system having separate pressurization flow means and fluid dispensing means, and an external pressure generation system. The invention optionally provides an external dispenser control device.

BRIEF DESCRIPTION OF THE DRAWINGS

FIG. 1 is a schematic view of the bottle closure/beverage dispensing system.

FIG. 2 is a cross-sectional side view of the closure cap assembly.

FIGS. 3 and 4 are cross-sectional views of alternate sealing means for the closure cap assembly of FIG. 2.

DESCRIPTION OF THE PREFERRED EMBODIMENTS

Figure 5:
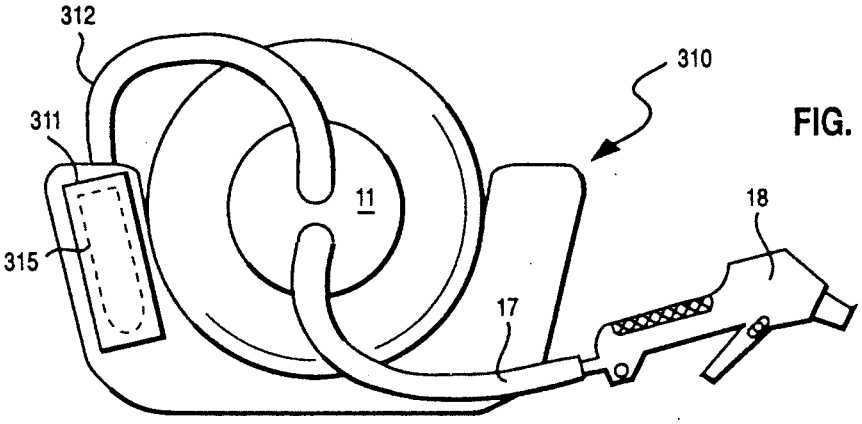
FIG. 5 is a side view of an alternate embodiment of the invention which utilizes a horizontal system.

Referring now to the drawings, and more specifically to FIG. 1, a beverage dispensing system 10 is illustrated having a bottle cap assembly 11 (which is described in greater detail hereinafter with reference to FIG. 2). The bottle cap assembly 11 is threaded internally so that it can be attached in sealing arrangement onto the top of a conventional container such as a blow-molded plastic beverage bottle represented at 12 which is made of a common container material such as poly(ethylene terephthalate).

A pressurized-gas (such as CO2 or air) supply conduit 13 is connected to the appropriate connector nozzle 14 of assembly 11 and leads to a pressure-generating gas supply unit 15 which may be one of several possible sources. One possible source would be a small battery-operated air compressor such as those known in the compressor industry and available for such purposes as inflating balloons, bicycle tubes, footballs, etc. Alternatively, the unit could hold a compressed gas cartridge such as a CO2 cartridge commonly utilized in pellet guns, soda siphons, and air guns. The unit also contains a pressure-operated switch set to automatically operate the compressor or to open the CO2 valve when the pressure in line 13 drops below a predetermined desirable level. Unit 15 also contains a manual switch (not shown) which overrides the automatic switch and allows the unit to be stored when not in use or when changing the beverage bottles. Optionally, and preferably, unit 15 also contains a commercially available pressure relief valve (also not shown) arranged to prevent uncontrolled pressurization of the beverage bottle. The above apparatus are not disclosed in greater detail because they are commercially available in their individual components and can be assembled without need for additional detail herein.

A siphon tube 16 is located through an opening in assembly 11 and arranged to extend downward into the beverage bottle to a point near the bottom thereof. Tube 16 preferably is sealed into assembly 11, either permanently by means such as epoxy or other cement, or by temporary means such as circumferential seal rings as illustrated in figures 3 and 4. Tube 16 extends upwardly out of assembly 11 a small distance to receive in tight engagement thereon a dispensing conduit 17 to which is attached at the opposite end a dispenser handle 18 having a dispenser nozzle 19 thereon. Dispenser handle 18 has an internal cutoff valve (not shown) which is operated by external lever 20 pivotally mounted on handle 18. The cutoff valve is preferably biased into a normally-closed position by resilient means, which bias can only be overcome and the valve opened, by squeezing lever 20 against handle 18, thereby allowing beverage to be dispensed through conduit 17 and out nozzle 19. Dispenser nozzle assembly 18,19,20 is a commercially available device.

Referring now to FIG. 2, the bottle cap assembly 11 is shown in greater detail. The assembly comprises a cap body member 21 having a generally cylindrical skirt 22 and a relatively flat top panel 23 formed at the top of the skirt section. Skirt section 22 has internal helical threads 24 formed circumferentially therein, adapted for threaded engagement on the standard threaded top portion of a plastic carbonated beverage bottle such as the common two-liter soft drink bottle sold commercially today.

A central opening or bore passage 25 is formed centrally in top panel 23 and comprises a substantial portion of the diameter of top member 23. Inside this opening is inserted a dual connector housing 26 having a flat bottom flange plate 27 with a substantially wider diameter than that of the opening 25, thereby providing a circumferential flange lip 28 around plate 27 for abutting the bottom of panel 23. Plate 27 is also wide enough to engage the top lip of a bottle (shown in phantom) onto which the assembly is threaded. An elastomeric seal member 29 is cemented, stretched, or otherwise removably attached to the bottom of plate 27 to provide sealing contact between flange lip 28 and the top of the beverage bottle. Seal member 29 is preferably made of some gas impermeable elastomer such as polyethylene, ethylene vinyl acetate (EVA), or ethylene vinyl alcohol (EVOH).

A first opening 30 is formed in plate 27 and defines a flow passage 32 leading into a flow connector 31 formed in an upwardly projecting position on plate 27. Connector 31 projects up through opening 25 in panel 23 and has a connector nozzle 33 formed at the top thereof, for receiving the elastomeric tubing of conduit 17 thereon. An annular opening 34 is formed internally in the lower end of connector 31 to received the upper end of siphon tube 16 illustrated in FIG. 1. Although the siphon tube of FIG. 1 is shown therein as extending out of the assembly 11, in this embodiment, the tube extends only into annular opening 34 and is sealed there by means such as interference fit, cementing or fusing. In the alternate embodiments of FIGS. 3 and 4, the siphon tube does extend completely out of the assembly 11.

A second opening 35 is also formed in flow connector 31 and defines a second flow passage 36 through connector housing 26. At the top end of passage 36 is formed an annular enlargement 37 which is adapted to receive an ell connector nozzle 38 in sealing engagement therein. Ell 38 is preferably formed for an interference press-fit in opening 37 and is permanently fitted therein by means such as cementing or fusing during assembly of the closure system. Ell 38 has at its outer end a serrated nozzle portion 39 for receiving in tight-fitting engagement thereon elastomeric tubing 13 (FIG. 1).

In a typical initial assembly operation, connector housing 26 without ell 38 is placed through opening 25 and the whole assembly 11 is threaded via threads 24 onto the beverage bottle to be emptied. The skirt portion 22 is threaded down onto the bottom threaded portion until seal member 29 is compressed sufficiently to effect a good gas seal of the assembly to the bottle. After the proper tightening of the threaded skirt on the bottle, a resilient spring retainer ring 40 is spread apart and slipped over the housing 26 until it engages peripheral groove 41 formed in housing 26. This allows the assembly to be removed from a bottle without the housing 26 falling out of the cap body member 21. Ell connector 38 is then sealed into annular opening 37 and sealed therein as previously described, effectively sealing against gas loss around the connector. Alternatively, ell connector 38 may be sealed in annular opening 37 prior to attachment of the threaded skirt portion onto the beverage bottle.

In typical operation of the gas replacement and dispensing functions (referring to FIGS. 1 and 2), after the siphon tube 16 is pressed or cemented into annular opening 34, assembly 11 is attached to a full beverage bottle and connector 38 is sealed into housing 26. The remote pressurization unit 15 is attached via flexible conduit 13 to connector 38 at serrated end 39. The manual actuation switch (not shown) on unit 15 is switched on, thereby actuating the automatic pressure switch which has been set at a predetermined desirable pressure such as 2 or 3 pressures above atmospheric pressure. This begins the pressurization, which as previously mentioned, may comprise either a battery-operated or house-current electric-operated pump, or a pressure cartridge such as a CO2 bottle.

Prior to activation of the switches, the dispensing conduit 17 is pressed onto or otherwise attached to outlet connector 33. Activation of the switches then allows pressurization of the headspace above the liquid in the beverage bottle. This pressurization serves at least two purposes and possibly even three. First, it pressurizes and maintains a preset pressure on the area above the carbonated liquid, thereby maintaining a vapor pressure sufficient to maintain carbon dioxide in solution in the beverage. As long as there is sufficient gas pressure on top of the liquid, the carbonation will remain in solution in the beverage. Second, the pressurization allows liquid to be forced into siphon tube 16 and out through conduit 17 to dispensing handle 18. Pressing of lever 20 opens the normally-closed internal valve in handle 18 and allows beverage to be dispensed out nozzle 19.

A third desirable function of pressurization can be achieved if the pressurization is accomplished with compressed CO2, such as through the use of carbon dioxide cartridges in pressurization unit 15. This can result in the beverage having replacement of CO2 previously lost through permeation or headspace loss. A pressurized volume of CO2 above the liquid in the headspace will result in CO2 dissolving back into the liquid until the vapor pressure of the CO2 therein equals that of the volume in the headspace. Also CO2 will be replaced as it is lost through the walls of the beverage bottle, and the liquid can be kept "fresh" as long as the CO2 supply in unit 15 holds up.

FIG. 3 discloses a second embodiment of the seal means between the siphon tube and housing 126. In this embodiment, housing 126 has serrated upper end 133, connector body 131, snapring retainer groove 141, flange 128, plate 127, and bore 132. An elastomeric seal band 150 is located in the internal bore 132 in an annular groove 151 formed therein. Seal band 150 can be of some impermeable elastomer such as EVOH and preferably is sized for tight-fitting engagement in groove 151. This provision of an elastomeric seal allows the siphon tube to be adjusted upward and downward for different sizes of bottles. Preferably, the siphon tube will be slightly smaller than the diameter of bore 132 but larger than the inner diameter of seal band 150.

FIG. 4 discloses an alternate embodiment to that of FIG. 3, in which the elastomeric seal means comprises three O-ring seals 250, 251, and 252 located in matching annular O-ring grooves 253, 254, and 255 formed in the wall of bore 232 in connector body 226.

FIG. 5 illustrates a different embodiment of the system of FIG. 1, in which a generally U-shaped, hollow cradle 310 is formed of a strong lightweight material such as polyethylene, polystyrene, or polypropylene. The removable pressurization unit shown in phantom is contained in the hollow wall of the cradle 310, and can be accessed through door 311. This comprises the same type of pressurization system as disclosed in FIG. 1. An outlet conduit 312 is formed on or attached to a connector passing through the wall of cradle 310, connecting to the hidden pressurization unit 15, and leads to the connector section 39 on closure assembly 11. A second conduit 17 is connected to closure assembly 11 and communicates to dispenser handle 18 as previously described. In this embodiment, the beverage bottle may be advantageously situated horizontally in the refrigerator or cooler. It is preferable that the siphon tube be angled toward the lowermost side of the bottle bottom to allow the maximum delivery of liquid from the bottle.

Figure 6:
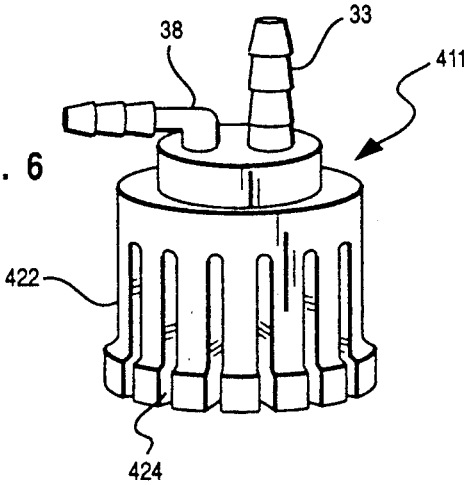
FIG. 6 is a prospective side view of another embodiment of the invention.
Figure 7:
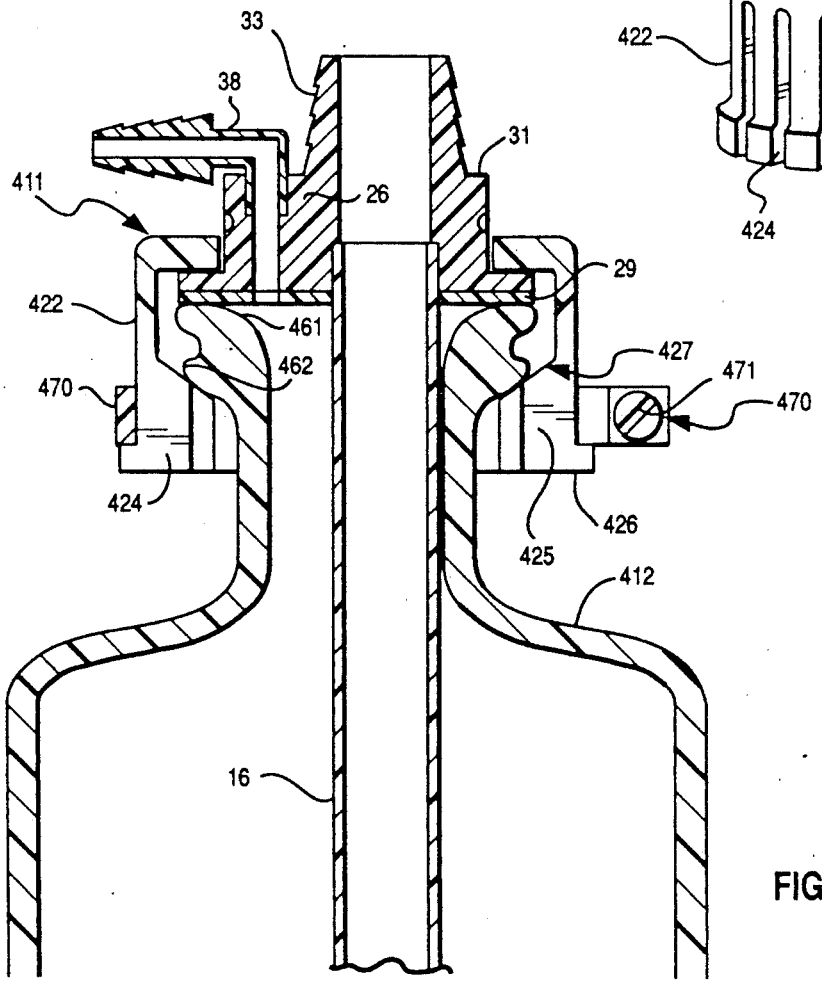
FIG. 7 is a cross-sectional side view of the embodiment of FIG. 6.

Referring now to FIGS. 6 and 7, an alternate embodiment of the invention is disclosed which is particularly useful and is adapted for use on non-threaded bottle-type containers which have an external upset section at the neck opening. The upset section serves to form a peripheral rounded ridge on the external surface of the bottle neck near the top. Thus, instead of having an internal threaded skirt portion, the bottle cap assembly 411 has a cylindrical colleted skirt section 422 formed from a cylindrical section which has had a plurality of longitudinal, generally parallel slots 424 cut therein from the bottom thereof to a point near the top. This can be seen in better detail in the cross-sectional view of FIG. 7.

In FIG. 7, cap assembly 411 has been snapped over the neck of a non-threaded bottle 412 which has a rounded top rim 461 and just below that, a rounded upset ridge 462. An elastomeric seal member 29 has been removably attached to the bottom of connector housing 26 and sealingly abuts bottle rim 461. Connector housing 26 and seal member 29 are maintained in sealing abutment with rim 461 by the means of biasing shoulder 427 which defines the upper part of thickened skirt section 425. The slope or angle of shoulder 427 serves to wedge cap assembly downward by the action of slope 427 on ridge 462. This is maintained by tightening means such as screw clamp 470 which is a commercially available item such as a standard automotive heater hose clamp which can be tightened and loosened by means such as screw 471.

In typical assembly operation, the clamp 470 is in a loosened configuration and the collet sleeve is snapped over the upset ridge of a bottle neck and moved down until the shoulder 427 passes under the bottle ridge. Clamp 470 is then tightened by turning screw 471, thereby pulling cap assembly downward on the bottle neck by means of the wedge shoulder 427 and ridge 462 until seal 29 is compressed onto bottle rim 461 in tight-sealing engagement thereagainst. The operation of the closure assembly is then similar to that of the previously described embodiments.

Thus the present invention discloses a system for the pressurization, dispensing, and carbonation of beverage in a beverage bottle. The apparatus offers the advantage of being able to dispense beverage without opening the headspace of the bottle to the atmosphere, thereby preserving the carbonation pressure of the headspace. It also offers the advantage of maintaining a positive pressure in the headspace volume to prevent bubbling out of CO2 from the beverage liquid. A third advantage of the system is that it offers a convenient pressurized dispensing system. A fourth possible advantage is that, with the use of a pressurized CO2 source, carbonation lost from the liquid may even be replaced while the bottle is attached to the dispensing system.

Other advantages include the automatic replacement of pressure lost when $CO_2$ in the headspace is dissipated due to permeation through the plastic walls of the bottle; storage of the bottle in a horizontal position in the refrigerator; and minimum handling of the bottle to dispense liquids, thereby minimizing loss of $CO_2$ caused by agitation of the liquid.

Although specific preferred embodiments of the present invention have been herein described in the detailed description above, the description is not intended to limit the invention to the particular forms or embodiments disclosed therein since they are to be recognized as illustrative rather than restrictive, and it will be obvious to those skilled in the art that the invention is not so limited. For example, whereas the closure assembly is disclosed as comprising two primary subassemblies, the cap body member and the dual connector housing, it is obvious that these two could be made as a single, integral unit by merely designing the two connector nozzles to both point upward rather than having the pressurization nozzle shaped as an ell, pointing horizontally. Also whereas the assemblies are preferably made of a tough inexpensive plastic such as polyethylene, polystyrene, or polypropylene, the material could be more esoteric plastics such as PET, polycarbonates, or PVC. Alternatively the parts could be partially or wholly made of other materials such as glass or metals. Thus the invention is declared to cover all changes and modifications of the specific examples of the invention herein disclosed for purposes of illustration which do not constitute departure from the spirit and scope of the invention.

The embodiments of the invention in which an exclusive property or privilege is claimed are defined as follows:

1. A closure and dispensing system for a beverage bottle containing carbonated beverage, said closure and dispensing system comprising:

a closure cap assembly including a cap member adapted for tight-fitting engagement over the open end of a beverage bottle and seal means in said cap member adapted for sealing engagement with a beverage bottle neck;

said closure cap assembly further comprising a first flow connector defining a first flow passage through said assembly, and a second flow connector defining a second flow passage through said assembly, said connectors arranged to project outwardly from a beverage bottle and said flow passages arranged to communicate with the interior of a beverage bottle when said assembly is engaged on the end of a beverage bottle;

a pressure generating assembly adapted for generating a gas pressure at any desirable time, and further adapted for generating a gas pressure above a predetermined preset value;

a flow conduit connected to said pressure generating assembly at one end and connected to said first connector at the other end and arranged to conduct pressurized gas from said generator to said first flow passage;

a valved fluid dispensing system including a siphon tube securely fixed in said second flow passage and arranged to project downward into a beverage bottle, a dispenser nozzle valve assembly, and a second flow conduit connected to said second connector at one end and to said dispenser nozzle valve assembly at the other end; and, a cradle housing having a generally U-shaped hollow housing body adapted for normal horizontal orientation and further adapted to receive a beverage bottle in close-fitting relationship therein; said pressure generating assembly being removably contained in said housing body.

2. The bottle closure and dispensing system of claim 1 wherein said pressure generating assembly comprises an electrically operated air compressor.

3. The bottle closure and dispensing system of claim 1 wherein said pressure generating assembly comprises a container of compressed carbon dioxide.

4. The bottle closure system of claim 1 further comprising a siphon tube connected to said second flow passage and arranged to project downwardly into a beverage bottle.

5. The bottle closure system of claim 4 wherein said siphon tube is securely fixed in said flow passage by permanent attachment means including fusing and cementing.

6. The bottle closure system of claim 4 wherein said second flow passage contains an internal flexible seal and said siphon tube passes through said flow passage in slidable sealing engagement with said seal.

7. The bottle closure system of claim 1 wherein said cap member comprises attachment means for securing said cap member to the top of a beverage bottle.

8. The bottle closure system of claim 7 wherein said attachment means comprises internal helical threads formed in said cap member adapted for threaded engagement on the threaded neck of a beverage bottle.

9. The bottle closure system of claim 7 wherein said cap member has at least one longitudinal slot formed through the wall thereof passing through a substantial portion of the length of said cap member; and said attachment means comprises a wedge surface formed in said cap member, and adjustable tightening means on said cap member arranged to provide circumferential tightening of said cap member on a beverage bottle.

10. The bottle closure system of claim 1 wherein said cap member comprises a first section and a second section, said first section comprising a skirt section adapted for close-fitting arrangement on the neck of a beverage bottle and a relatively flat top panel formed on said skirt section with a centrally located opening therethrough, and said second section comprising a connector housing having said seal means removably attached to the bottom thereof and said first and second flow passages formed therethrough; said centrally located opening adapted for relatively close-fitting engagement of said connector housing therein.

* * * * *